United States Patent [19]

Bailey

[11] 4,106,573

[45] Aug. 15, 1978

[54] DRILL

[75] Inventor: Edward A. Bailey, Newport, N.H.

[73] Assignee: Joy Manufacturing Company, Pittsburgh, Pa.

[21] Appl. No.: 722,811

[22] Filed: Sep. 13, 1976

[51] Int. Cl.[2] ..... B25D 9/00

[52] U.S. Cl. ..... 173/106; 279/19.3

[58] Field of Search ..... 173/105, 106, 107, 108; 279/19.3, 19.6, 19.7, 78, 79; 408/226, 239

[56] References Cited

U.S. PATENT DOCUMENTS

| | | | |
|---|---|---|---|
| 1,822,115 | 9/1931 | Shepherd | 279/19.3 |
| 2,776,840 | 1/1957 | Schorer | 279/19.3 |
| 3,797,584 | 3/1974 | Bailey et al. | 279/19.3 |

FOREIGN PATENT DOCUMENTS

| | | | |
|---|---|---|---|
| 65,620 | 1/1927 | Sweden | 279/19.7 |

*Primary Examiner*—Robert Hafer

*Attorney, Agent, or Firm*—J. Stewart Brams

[57] ABSTRACT

This invention relates generally to improved means for securing a working member within a rotary tool and is described hereinbelow with particular reference to a percussively actuatable striking bar secured by the novel securing means hereof within a percussive rock drilling apparatus.

13 Claims, 4 Drawing Figures

DRILL

Prior rock drills have commonly included an elongated striking bar retained within and extending outwardly of the forward end of the drill and actuatable in one or more drilling modes such as simultaneous percussive and rotary actuation to drill a bore hole by means of an elongated drill string secured to the free end of the striking bar. Such prior drills generally may be classified as either open front end or closed front end drills depending upon the structure of the striking bar retention means therein. Those drills requiring some front end disassembly, front cap removal for example, to remove or insert the striking bar are the closed front type while those requiring no such disassembly for striking bar removal or replacement are the open front type. In view of the requirement for relatively frequent striking bar replacement in the field an open front drill is preferable to a closed front drill due to the comparative ease and efficiency of striking bar removal afforded thereby. Examples of known open front drills are the lug type wherein lugs formed intermediate the ends of the striking bar cooperate with groove means in the drill chuck to secure the striking bar within the front end of the drill in the manner of a bayonet lock, and the latching type wherein a latch member is carried adjacent the front end of the drill to secure the striking bar by engaging a peripheral portion thereof.

Although heretofore known open front drill arrangements have generally served the intended purposes, they have nevertheless often been subject to serious deficiencies. For example, may prior open front drills have not been adapted for powered disengagement of the striking bar therefrom and striking bar removal, although somewhat simplified, has remained a relatively inefficient and difficult manual task. Additionally, in many independent rotation drills the striking bar includes a plurality of circumferentially spaced drive splines which are engageable with rotary drive means within the drill, and such splines have been incompatible with open front type striking bar retention means. Therefore, prior attempts to utilize an open front drill configuration in an independent rotation drill or in conjunction with such a splined striking bar generally have not succeeded.

These and other deficiencies of the prior art are alleviated by the instant invention which in its preferred embodiment provides an open front drill configuration wherein an enlarged portion of the striking bar such as a plurality of circumferentially spaced rotary drive splines intermediate the ends thereof cooperates with a lost motion rotary means to selectively secure or release the striking bar by selective misalignment or alignment of the striking bar splines with cooperating portions of the rotary means.

It is therefore an object of this invention to provide an improved and efficient means for retaining a working member within a rotary tool.

A more specific object of this invention is to provide an improved and efficient striking bar retention means for securing a striking bar within a rock drill.

A still more specific object of this invention is to provide an improved striking bar retention means for use in securing a splined striking bar in an open front drill.

A further object of this invention is to provide an efficient and quickly operable securing means which cooperates with a conventionally splined striking bar to retain the bar within a rock drill by forward drill rotation and to release the striking bar by reverse drill rotation.

These and other objects and advantages are more fully specified in the following description of the invention with reference to the accompanying figures, in which.

Figure 1:
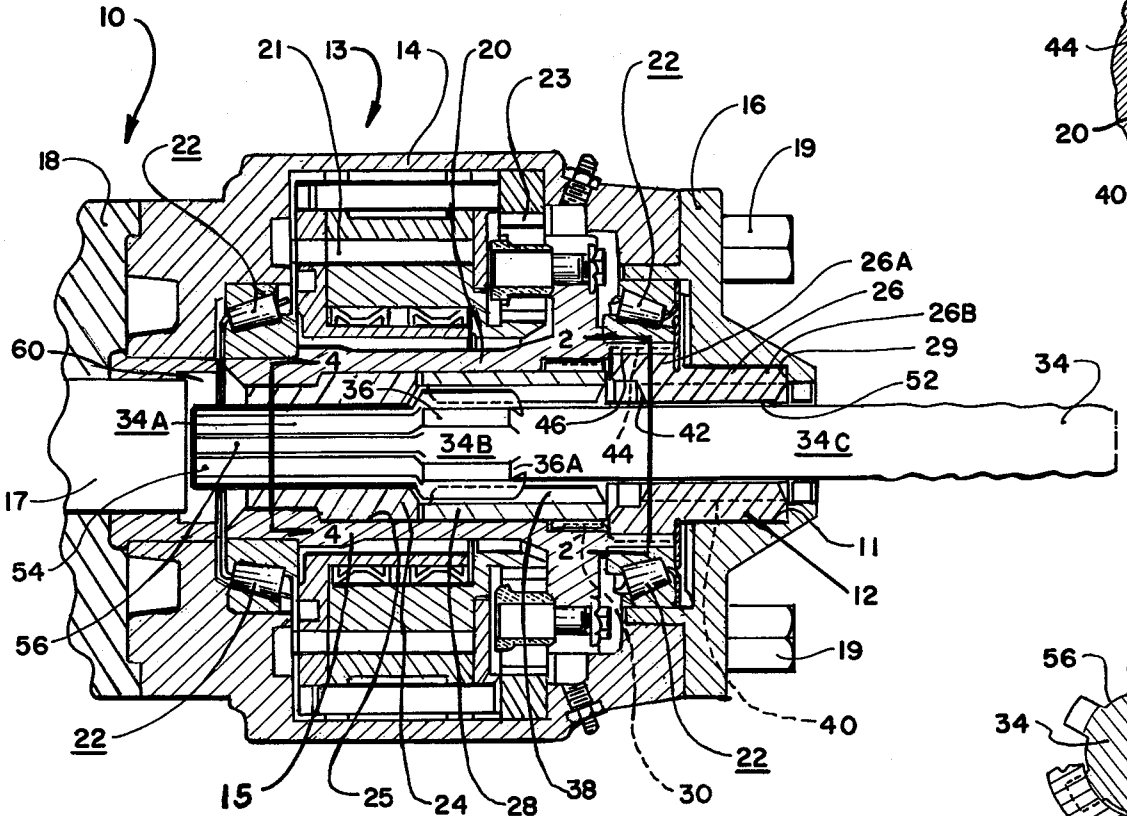
FIG. 1 is a central axial section of a rock drill forward end portion including striking bar retention means according to one embodiment of the instant invention.

There is generally indicated at 10 in FIG. 1 the forward end portion of a powered actuator, specifically a rock drill including a forward or yoke portion 13 which has therewithin an elongated cylindrical striking bar 34 retained by retention means generally indicated at 12 and constructed according to one embodiment of the principles of the present invention. Yoke 13 comprises an elongated, generally annular housing 14 rigidly secured coaxially intermediate a generally annular front cap 16 and an elongated percussor portion 18 (forward end shown) by any suitable securing means such as a plurality of conventional longitudinally extending side rods (not shown) secured by threaded fasteners 19.

In operation a hammer piston 17 reciprocably carried within portion 18 repetitively impacts the rearward end of striking bar 34 simultaneously with independent rotation of striking bar 34 about its axis by means described hereinbelow to provide a rotary, percussive drilling action for drilling a bore hole in the conventional manner. Accordingly, striking bar 34 is rotatably supported within yoke 13 for axial rotation by a drive means including an elongated chuck assembly 20 which is suitably rotatably journaled within housing 14 as by conventional axially spaced annular roller bearing assemblies 22 for rotation, for example, by an annular motor means 21 and planetary gear train 23 as more fully described in U.S. Pat. No. 3,858,666. Assembly 20 includes an elongated, generally cylindrical chuck member 15 having a stepped axial through bore 25 which carries therewithin a generally annular rear chuck bushing or bearing means 24 located coaxially adjacent the rearward end of bore 25 and an elongated generally annular chuck driver member 28 disposed coaxially forwardly adjacent bushing 24. Bushing 24 and driver 28 are press fitted within bore 25 and driver 28 additionally is maintained in suitable rotary driving relationship with member 15 as by engagement of respective circumferentially spaced mating splines indicated at 30 which encompass adjacent peripheral portions of driver 28 and bore 25. A generally annular elongated forward striking bar bushing or bearing member 26 is located coaxially forwardly adjacent driver 28 such that a rearward end portion 26A thereof is engaged in rotary driving engagement within the forward axial end of bore 25 in a manner to be described hereinbelow, and a forward end portion 26B thereof is rotatably supported within a through bore 11 extending coaxially within cap 16. As is well known, cap 16 when assembled to yoke 13 serves to captively retain bearings 22 and chuck assembly 20 within yoke 13, and further serves to captively retain forward bushing 26 axially intermediate driver 28 and an annular thrust bearing surface 29 formed coaxially adjacent the forward end of bore 11.

The coaxially adjacent inner peripheries of rear bushing 24, driver 28 and forward bushing 26 are sized to coaxially slidably receive striking bar 34 therewithin with axially spaced rearward and forward striking bar portions 34A, 34C rotatably supported within respective bushings 24, 26. An intermediate striking bar drive portion 34B extends axially intermediate portions 34A, 34C and includes a plurality of circumferentially spaced radially outwardly extending drive splines 36 which are engaged in rotary driving engagement with cooperably formed splines 38 spaced circumferentially about the inner periphery of driver 28 whereby striking bar 34 may be driven in axial rotation by motor 21.

Figure 2:
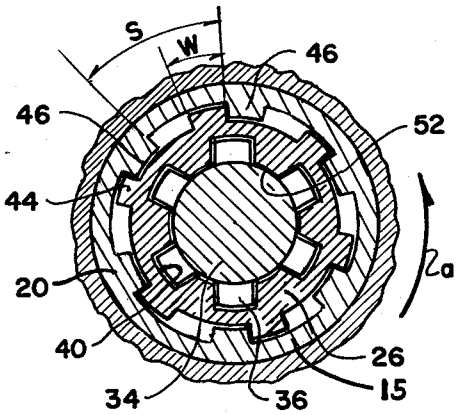
FIG. 2 is a fragmentary transverse section of the drill of FIG. 1 taken on line 2—2 of FIG. 1 and showing the striking bar in the non-retained state.
Figure 3:
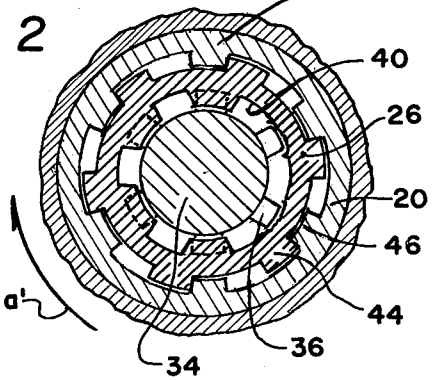
FIG. 3 is a transverse section similar to FIG. 2 with portions broken away to show the striking bar in the retained state.

In order to permit removal and insertion of striking bar 34 in yoke 13 without disassembly of cap 16 from the drill, all portions of striking bar 34 located within yoke 13 are suitably dimensioned to permit the striking bar 34 to pass axially through bushing 26. Accordingly, the inner periphery of bushing 26 is provided with a plurality of circumferentially spaced, axially extending grooves 40 (FIGS. 1 and 2) sized and located to receive splines 36 such that when the splines 36 are circumferentially aligned with grooves 40 as in FIG. 2 striking bar 34 may pass through bushing 26 as desired. When splines 36 are circumferentially misaligned with grooves 40 (FIG. 3) striking bar 34 is retained within yoke 13 by abutment of a forward axial end 36A of splines 36 upon a plurality of rearward end surface portions 42 of bushing 26 which are formed circumferentially intermediate grooves 40. Rearward striking bar end portion 34A may be dimensioned as forward end 34C to be slidable and rotatable within bushing 26, or may be formed with an enlarged nominal diameter as described hereinbelow.

To provide for selective retention and release of striking bar 34 the rearward end portion 26A of bushing 26 is keyed in rotary driving engagement within member 15 by respective cooperating pluralities of circumferentially spaced splines 44 and 46 (FIGS. 2 and 3) to be driven in axial rotation at the same rotary speed as assembly 20 and striking bar 34. In the preferred embodiment, the circumferential spacing "S" between adjacent splines 46 is approximately twice the width "W" of splines 44 to provide a lost motion rotary connection therebetween which permits sufficient relative axial rotation between bushing 26 and striking bar 34 for the desired alignment and misalignment of grooves 40 and splines 36 as follows. During rotation of assembly 20 in one rotary direction (shown as counterclockwise by the arcuate arrow *a* in FIG. 2) the engagement of splines 44 and 46 is such that bushing 26 assumes a rotary position with respect to assembly 20 and striking bar 34 whereat splines 36 and grooves 40 are circumferentially aligned to release striking bar 34 whereby bar 34 may pass axially through bushing 26. Upon reversal of rotation to the opposite or clockwise direction as shown by the arcuate arrow *a'* in FIG. 3, assembly 20 drives striking bar 34 in clockwise rotation with respect to bushing 26 through an arc S minus W whereby splines 36 are circumferentially misaligned or offset from grooves 40 to retain striking bar 34 within yoke 13 by axial abutment of surfaces 36A, 42 as described hereinabove. In practice the rotary direction *a'* for striking bar retention will be that direction employed for drilling operations, commonly called forward rotation as contrasted with the opposite rotary direction, a, which is commonly called reverse rotation. Thus, the striking bar 34 is positively retained during drilling operations and is power released for removal from drill 10 by reverse drill rotation.

It is to be understood that inasmuch as the selective striking bar retention is by limited relative rotation thereof with respect to a retention means, bushing 26 in the present instance, the rotary connection permitting such relative rotation may be provided in rotary connections other than splines 44–46. For example, a lost motion rotary connection similar in all respects to that described hereinabove may be provided by splines 36–38. Additionally, it will be appreciated that the lost motion rotary connection may be provided by splined connections of widely varying design with different ranges of rotary free play, numbers and dimensions of splines, and so forth, as well as by others (non-splined) rotary lost motion connections.

Figure 4:
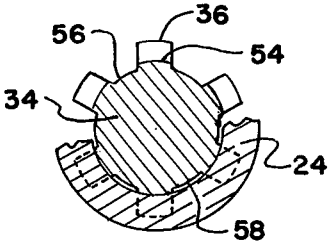
FIG. 4 is a fragmentary transverse section of FIG. 1 taken on line 4—4 of FIG. 1.

The striking bar utilized in conjunction with the retention means described hereinabove may be any of a variety of striking bars but preferably is the novel striking bar described hereinbelow wherein end portion 34A rearward of splines 36 is of a larger nominal diameter than the inner periphery of bushing 26 through which the bar 34 is passed during the striking bar removal and replacement. More specifically, striking bar forward end portion 34C is of a suitable diameter for a sliding fit within a radially inner bearing portion 52 of bushing 26 which is defined circumferentially intermediate grooves 40 (See FIG. 2). However, the striking bar rearward end portion 34A is of a larger nominal diameter than the bearing surfaces 52 by virtue of having a plurality of circumferentially spaced, axially extending lands 54 (FIGS. 1 and 4) aligned with ones of splines 36, and intervening axially extending grooves 56 the diameter across which is substantailly the same as or smaller than the diameter of forward end portion 34C. During striking bar removal and replacement the lands 54, which are aligned with ones of splines 36, register with respective grooves 40 and therefore do not interfere with smaller diameter bearing surface portions 52. Likewise, grooves 56, being of the same or a smaller diameter than portion 34C, may be passed through bushing 26 whereby all portions of the striking bar 34 contained within yoke 13 are able to be passed axially through bushing 26.

The described striking bar configuration affords numerous advantages not available heretofore in open front drills. For example, throughout the axial engagement of the inner periphery of rear bushing 24 with lands 54, each groove cooperates with the adjacent lands 54 and the inner periphery of bushing 24 to provide axially extending clearance spaces 58 (FIG. 4) circumferentially intermediate adjacent lands 54 through which otherwise isolated regions such as volume 60 adjacent the impact end of piston 17 (FIG. 1) may be vented to preclude fluid pressure accumulations therein. Clearance spaces 58 additionally may be used to conduct lubricant, perhaps in the form of an air-oil mist to lubricate wear surfaces in yoke 13. Furthermore, rearward end portion 34A is not limited to the standardized nominal diameter of the forward end portion 34C which is determined in part by the dimensions of commercially available drill steels and couplings. The enlarged nominal diameter rear end portion 34A provides added material mass and strength which is highly desirable to better sustain the impact blows of piston 17, particularly in view of mass and strength deficiencies which may commonly result, for example, from the enlarged coaxial bore (not shown) typically formed in the striking bar rearward end to receive a flushing fluid tube. The novel striking bar configuration described hereinabove is more completely described and claimed in U.S. application Ser. No. 722,920, filed Sept. 13, 1976 of E. A. Bailey and L. H. LeBlanc entitled "Striking Bar" which is assigned to the same assignee as the instant application and was filed contemporaneously herewith.

According to the description hereinabove the present invention provides a novel construction for an open front rotary device, particularly well suited for a rock drill, wherein a rotary working member may be selectively secured or released by selective rotation of the rotary actuator in opposite directions to actuate a retention means operable by a rotary lost motion connection. Notwithstanding the description hereinabove of a particular preferred embodiment of the invention, it is to be understood that this invention may be practiced in numerous alternative embodiments with various modifications thereto without departing from the broad spirit and scope thereof. For example, the rotary retention means need not necessarily be forward bushing 26 but may instead be a separate member located forwardly of splines 36 and rotatably drivingly engaged with assembly 20; various alternative configurations and number of splines on striking bar 34 may be employed; as indicated any suitable lost motion drive may be used to achieve the desired selective retaining and releasing of striking bar 34 by selective alignment and misalignment of cooperating striking bar and forward bushing portions.

These and other embodiments and modifications having been envisioned and anticipated by the inventor, the invention should be construed broadly and limited only by the scope of the claims appended hereto.

What is claimed is:

1. In an actuator adapted to receive therein a drive portion of an elongated working member and including selectively energizable drive means engageable in rotary driving engagement with said drive portion for axial rotation of said working member, the improvement comprising:

said actuator including working member retention means rotatable with respect to said drive means to retain said drive portion in rotary driving engagement with said drive means during rotation of said working member in one rotary direction only.

2. The improvement as claimed in claim 1 wherein said retention means additionally is rotatable with respect to said drive means to release said drive portion to permit disengagement thereof from said drive means upon reversing the rotational direction of said working member from said one rotary direction to the opposite rotary direction.

3. The improvement as claimed in claim 2 including a rotary driving connection between said retention means and said drive means.

4. The improvement as claimed in claim 3 wherein said rotary driving connection is a lost motion connection.

5. The improvement as claimed in claim 4 wherein said lost motion connection permits coaxial rotation of said retention means in opposite directions with respect to said working member to respective retention and release rotary positions thereof for said retaining and releasing, respectively.

6. The improvement as claimed in claim 5 wherein said lost motion connection includes respective pluralities of intermeshed drive splines and intervening grooves spaced circumferentially about axially adjacent peripheral portions of said drive means and said retention means and cooperable to permit said coaxial rotation of said retention means with respect to said working member.

7. The improvement as claimed in claim 6 wherein said drive splines and intervening grooves are intermeshed in a manner to provide said lost motion connection by means of a predetermined degree of rotary free play therebetween.

8. The improvement as claimed in claim 7 wherein said rotary free play is provided by said intervening grooves being wider than the respective ones of said drive splines engaged therein.

9. The improvement as claimed in claim 8 wherein said intervening grooves are in the range of twice the width of said respective ones of said drive splines engaged therein.

10. The improvement as claimed in claim 5 wherein said retention means coaxially encompasses a portion of said working member spaced axially from said drive portion and said release and retention rotary positions are positions whereat said retention means respectively permits and obstructs passage of said drive portion axially therethrough.

11. The improvement as claimed in claim 10 wherein said drive portion is an enlarged diameter splined drive portion.

12. The improvement as claimed in claim 2 wherein upon said reversing rotation direction said retention means additionally releases said working member to permit removal of said working member from said actuator.

13. A rock drill adapted to carry an elongated striking bar therein comprising: a percussive actuator; a rotary actuator; bearing means for carrying said striking bar for simultaneous percussive and rotary actuation thereof by said percussive and rotary actuators, respectively; and said bearing means including retention means cooperably rotatable with respect to said rotary actuator to retain said striking bar in said drill during rotation of said striking bar in one rotary direction and to release said striking bar for removal from said drill during rotation of said striking bar in the opposite rotary direction.

* * * * *